US009956535B2

(12) United States Patent
Weimer et al.

(10) Patent No.: US 9,956,535 B2
(45) Date of Patent: May 1, 2018

(54) CONTAINER FOR ACCOMMODATING HIGH-VISCOSITY MATERIALS

(71) Applicant: Putzmeister Engineering GmbH, Aichtal (DE)

(72) Inventors: Ralf Weimer, Stuttgart (DE); Raimund Maeckle, Esslingen (DE)

(73) Assignee: Putzmeister Engineering GmbH, Aichtal (DE)

( * ) Notice: Subject to any disclaimer, the term of this patent is extended or adjusted under 35 U.S.C. 154(b) by 450 days.

(21) Appl. No.: 14/437,594

(22) PCT Filed: Apr. 9, 2014

(86) PCT No.: PCT/EP2014/057138
§ 371 (c)(1),
(2) Date: Apr. 22, 2015

(87) PCT Pub. No.: WO2014/177349
PCT Pub. Date: Nov. 6, 2014

(65) Prior Publication Data

US 2015/0283525 A1 Oct. 8, 2015

(30) Foreign Application Priority Data

May 3, 2013 (DE) ..... 10 2013 208 101

(51) Int. Cl.
*B01F 15/02* (2006.01)
*B01F 7/00* (2006.01)
(Continued)

(52) U.S. Cl.
CPC ..... *B01F 15/0251* (2013.01); *B01F 3/14* (2013.01); *B01F 7/00391* (2013.01);
(Continued)

(58) Field of Classification Search
CPC ..... F04B 7/0088; F04B 7/0096; F04B 39/041
See application file for complete search history.

(56) References Cited

U.S. PATENT DOCUMENTS 4,114,902 A * 9/1978 Orlowski ..... F16J 15/4474 277/427
4,382,752 A * 5/1983 Schlecht ..... F04B 7/0096 417/516
(Continued)

FOREIGN PATENT DOCUMENTS

CN 201 170 317 Y 12/2008
CN 201 772 067 U 3/2011
(Continued)

OTHER PUBLICATIONS

International Search Report of PCT/EP2014/057138, dated Jun. 30, 2014.
(Continued)

*Primary Examiner* — Tony G Soohoo
*Assistant Examiner* — Elizabeth Insler
(74) *Attorney, Agent, or Firm* — Collard & Roe, P.C.

(57) ABSTRACT

A container for accommodating high-viscosity materials, such as liquid concrete. The container has at least one bearing sleeve, which extends through a wall opening and is fastened in the container wall in a liquid-tight manner. A shaft extends through the bearing sleeve in such a way that an annular gap is left open. A shaft seal, which bridges the annular gap and is made of elastomeric material, is located at the container-interior end of the bearing sleeve. A lubricant is applied to the annular gap from the container exterior. The invention is characterized in that the shaft seal has, on the side thereof radially facing the shaft, a conveying thread that supports the conveying of the lubricant in the direction of the container interior, which conveying thread advantageously communicates with the container interior via a check valve open to the container interior.

13 Claims, 7 Drawing Sheets

Figures 1A, 1B, 1C, 1D:
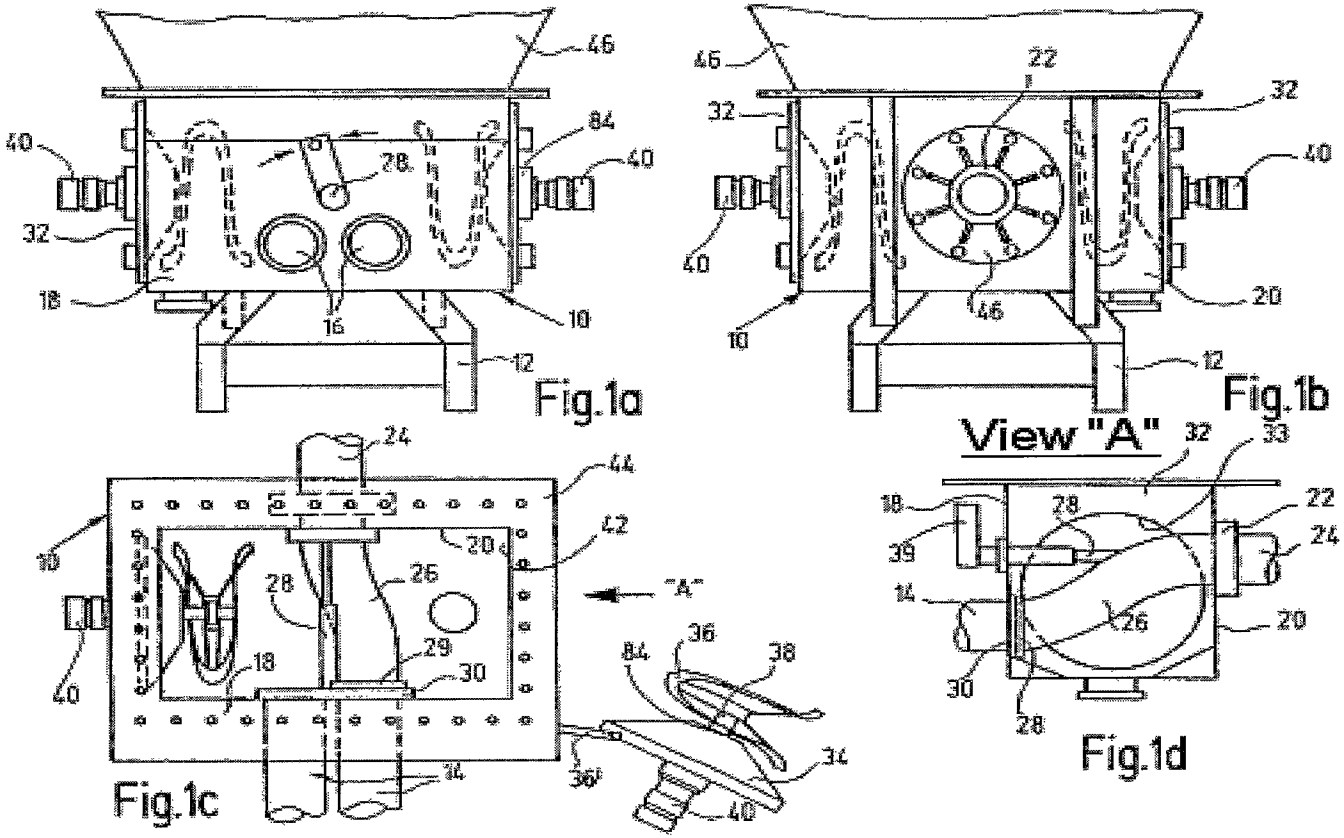

(51) Int. Cl.

| | |
|---|---|
| ***B01F 3/14*** | (2006.01) |
| ***F04B 7/00*** | (2006.01) |
| ***F04B 15/02*** | (2006.01) |
| ***F04B 53/18*** | (2006.01) |

(52) U.S. Cl.
CPC ..... *F04B 7/0019* (2013.01); *F04B 7/0023* (2013.01); *F04B 15/02* (2013.01); *F04B 15/023* (2013.01); *F04B 53/18* (2013.01); *B01F 2215/0047* (2013.01)

(56) References Cited

U.S. PATENT DOCUMENTS

| | | | | |
|---|---|---|---|---|
| 4,979,884 | A | 12/1990 | Letarte et al. | |
| 5,085,443 | A * | 2/1992 | Richards | B04B 3/02 277/412 |
| 6,932,350 | B1 * | 8/2005 | Husted | F16J 15/406 277/421 |

FOREIGN PATENT DOCUMENTS

| | | | |
|---|---|---|---|
| DE | 30 09 746 | A1 | 10/1981 |
| DE | 41 16 247 | C1 | 10/1992 |
| DE | 100 28 655 | A1 | 12/2000 |
| EP | 0 052 192 | A1 | 5/1982 |
| JP | 2013 061022 | A | 4/2013 |

OTHER PUBLICATIONS

German Search Report in 10 2013 208 101.4, dated Feb. 11, 2014, with English translation of relevant parts.

* cited by examiner

View "A"

CONTAINER FOR ACCOMMODATING HIGH-VISCOSITY MATERIALS

CROSS REFERENCE TO RELATED APPLICATIONS

This application is the National Stage of PCT/EP2014/057138 filed on Apr. 9, 2014, which claims priority under 35 U.S.C. § 119 of German Application No. 10 2013 208 101.4 filed on May 3, 2013, the disclosure of which is incorporated by reference. The international application under PCT article 21(2) was not published in English.

The invention relates to a container for accommodating high-viscosity materials, such as liquid concrete, with a bearing sleeve which reaches through a wall opening in the container and is fixed in the container wall in a liquid-tight manner, a shaft reaching through the bearing sleeve with an annular gap being left free, and with a shaft seal made from elastomeric material which is arranged at the container-interior end of the bearing sleeve and spans the annular gap, wherein the annular gap is acted upon with a lubricant from the container exterior.

Containers of this type are used, for example, as material feed containers in concrete pumps or as mixing containers in mortar mixing machines. The bearing sleeves serve there, for example, for the mounting of the drive shaft or of the pressure joint of a pipe branching assembly or for the mounting of the drive shaft for a stirring and mixing mechanism. In the case of the pressure joint bearing, the shaft is designed as a hollow shaft which, as a pressure joint, is part of the pipe branching assembly. The shaft seals used there serve primarily as strippers. In addition, the bearing points in the region of the annular gap are supplied with a lubricant which is squeezed out at an undefined position in the direction of the container interior via a sealing lip of the shaft seal. A disadvantage of this sealing arrangement is that it is not ensured that the bearing is flushed uniformly over the entire circumference and freed from contaminants. In addition, the pipe branching assembly or the stirring mechanism has to be removed for maintenance purposes.

Starting therefrom, the invention is based on the object of improving the container with a shaft bearing of the type specified at the beginning to the effect that the risk of contaminants from the container interior is significantly reduced and therefore bearing damage is substantially avoided, and the maintenance of the shaft bearing is facilitated.

In order to achieve this object, the combination of features described herein is proposed. Advantageous refinements and developments of the invention are also described herein.

The solution according to the invention is based on the concept that the shaft seal in the shaft bearing carries out a dual function, namely of reducing the risk of abrasive sealing material penetrating the annular gap of the shaft bearing and of reliably supplying the shaft bearing in the region of the shaft seal with lubricant over the entire circumference of the bearing point and of uniformly flushing said shaft bearing in the direction of the container interior. In order to achieve this, it is proposed, according to the invention, that the shaft seal has, on the side thereof facing the shaft radially, a conveying thread which supports the conveying of the lubricant in the direction of the container interior and expediently communicates with the container interior via a nonreturn valve opening toward the container interior. The lubricant therefore passes into the container interior locally at the end of the conveying thread and not, as previously, in a non-specific position via an encircling lip seal.

In a further preferred refinement of the invention, the nonreturn valve is formed by a slot opening or sealing lip bounding the conveying thread at the container-interior end thereof. In order to ensure that the lubricant always emerges at the same point, it is advantageous if an anti-twist means is arranged between the bearing sleeve and the shaft seal.

The conveying thread according to the invention ensures that the contact pressure force of the seal is increased under the lubricating pressure and therefore penetration of contaminants is avoided. If the conveying thread has a plurality of revolutions or forms a multi-start coil, it is ensured that the throughput of lubricant is used for actively flushing the entire shaft circumference and that contaminants are transported out of the annular space in a targeted manner. A further improvement in this respect is achieved if the pitch of the conveying thread decreases in the conveying direction of the lubricant. Furthermore, the conveying thread has the function of a collecting pocket, which acts in multiple stages in the axial direction, for penetrating contaminants over and beyond the entire shaft circumference. A multi-start conveying thread has a plurality of redundant sealing planes in the axial direction, which sealing planes can be worn over the entire length without a loss of function. The shaft seal here can also be of multi-part design and can therefore changed without removing the pipe branching assembly. The shaft seal advantageously engages here in an annular groove of the bearing sleeve, which annular groove is open toward the shaft surface, and, for the purpose of simplified maintenance, can be of multi-part design and can therefore be removed more easily. The individual parts of the seal are pressed together in a sealing manner by the lubricant pressure. The conveying thread output of the shaft seal can be configured, with the effect of a nonreturn valve, in the manner of a funnel which opens at a comparatively low lubricant pressure and protects the conveying thread from the container side against contamination. If the shaft seal is provided with an anti-twist means, the outlet of lubricant on the bearing sleeve always takes place at the same location. This permits a functional check of the lubricant by simple visual inspection while the machine is running.

According to a further advantageous refinement of the invention, the shaft seal has an encircling pocket which is open axially counter to the conveying direction of the lubricant and, under the action of the lubricant, brings about an additional contact pressure action against the shaft surface. The shaft seal here advantageously engages by means of the encircling pocket thereof in the annular groove of the bearing sleeve, and therefore said shaft seal is also sufficiently supported on the side of the bearing sleeve.

The container according to the invention is advantageously designed as a material feed container of a two-cylinder high-viscosity material pump which contains a pipe branching assembly. The bearing sleeve can be designed here as a flange bearing and/or as a pressure joint bearing of the pipe branching assembly.

In principle, the bearing sleeve can also form a stirring mechanism bearing.

The invention is explained in more detail below with reference to the exemplary embodiments which are illustrated schematically in the drawing, in which FIGS. 1*a, b* and *c* show a front view, a rear view and a top view of a material feed container with a pipe branching assembly and two stirring mechanisms;

FIG. 1*d* shows a view in the direction of the arrow A of FIG. 1*c;*

Figure 2:
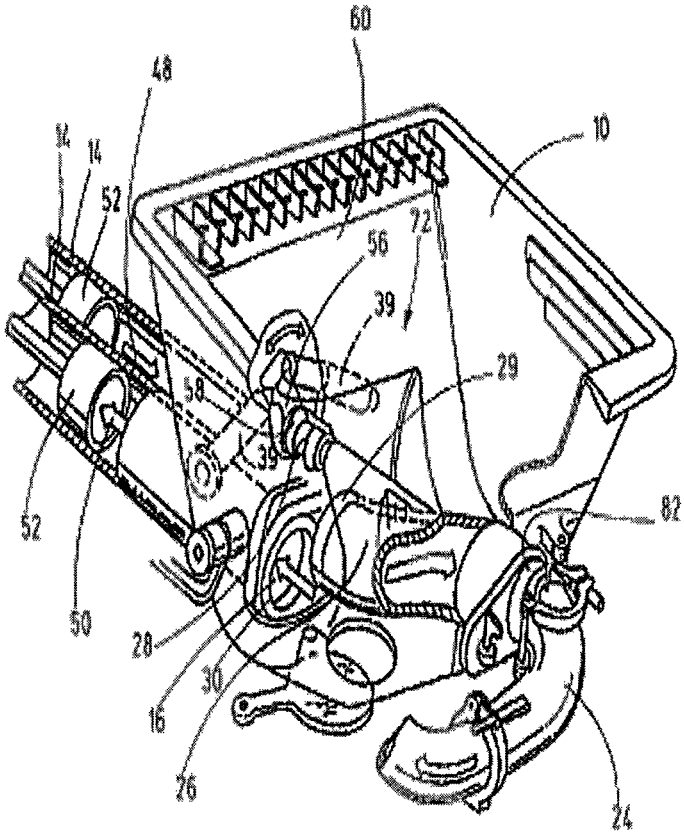
Figure 3A:
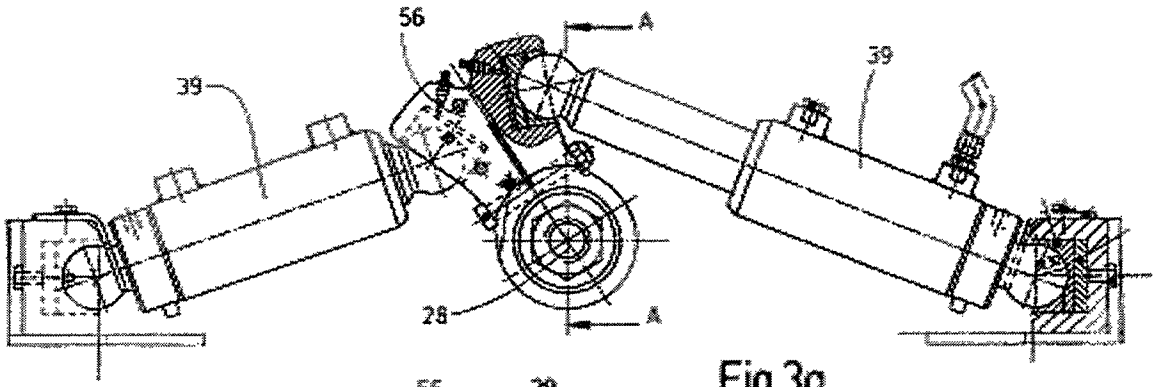
Figure 3B:
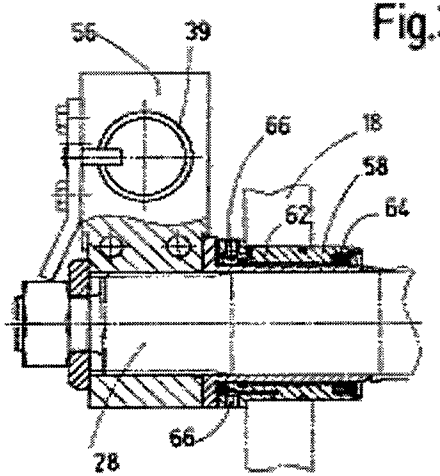

FIG. 2 shows a graphical illustration of an exemplary embodiment, which is modified in relation to FIGS. 1*a* to *d* of a material feed container with a pipe branching assembly as part of a two-cylinder high-viscosity material pump;

FIG. 3*a* shows a side view of the drive mechanism of the pipe branching assembly according to FIG. 2;

FIG. 3*b* shows a section along the intersecting line A-A of FIG. 3*a;*

Figure 4A:
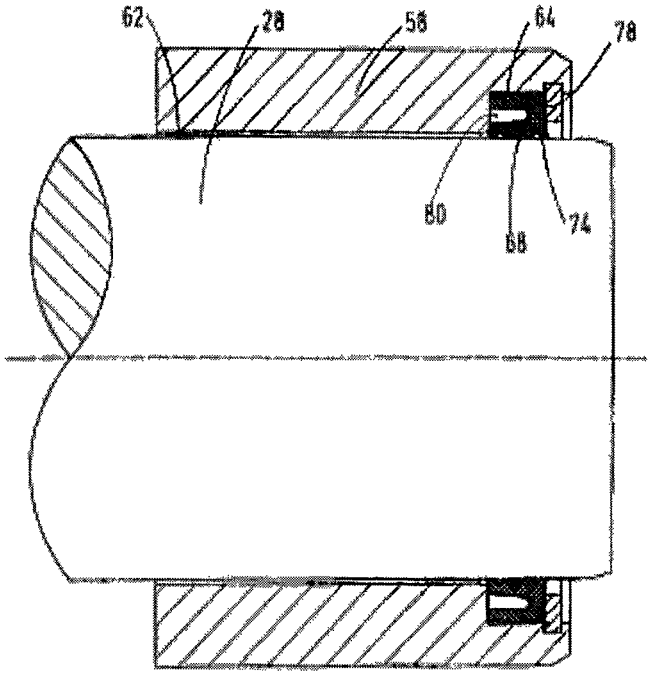
Figure 4B:
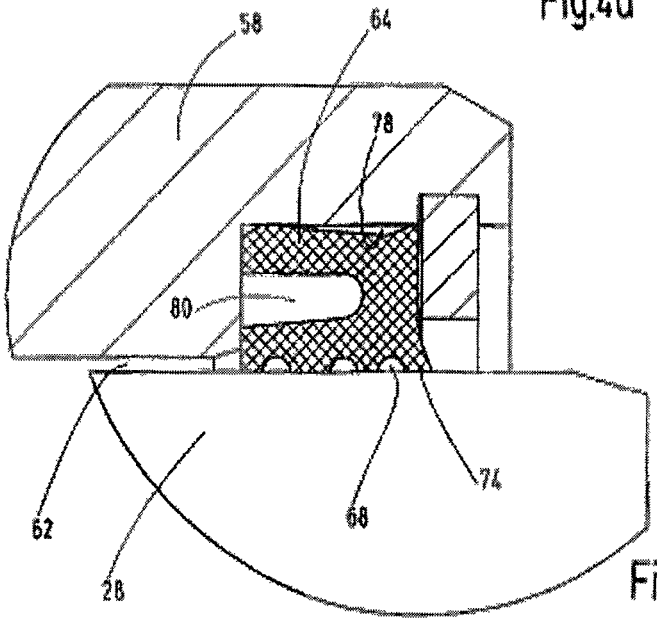

FIG. 4*a* shows a detail from the shaft bearing with the shaft seal;

FIG. 4*b* shows an enlarged detail from FIG. 4*a;*

Figure 4C:
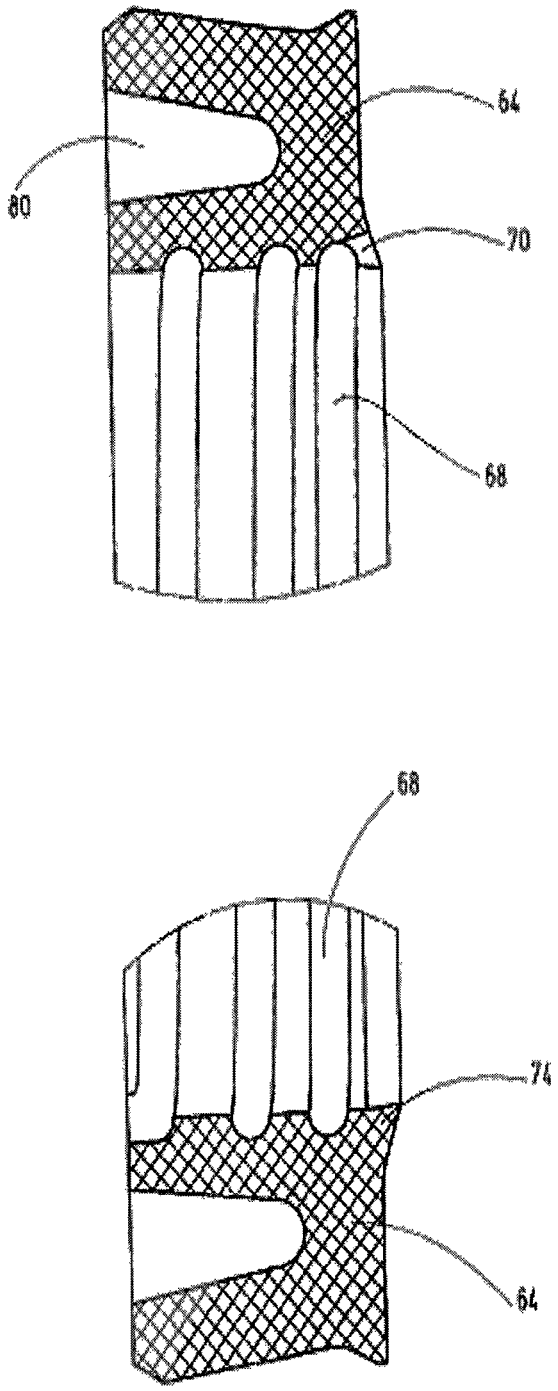

FIG. 4*c* shows a detail from the shaft seal according to FIGS. 4*a* and *b;*

Figure 4D:
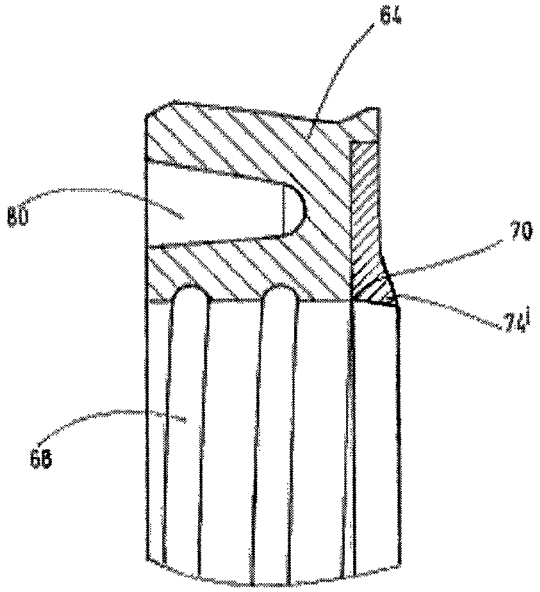
Figure 5A:
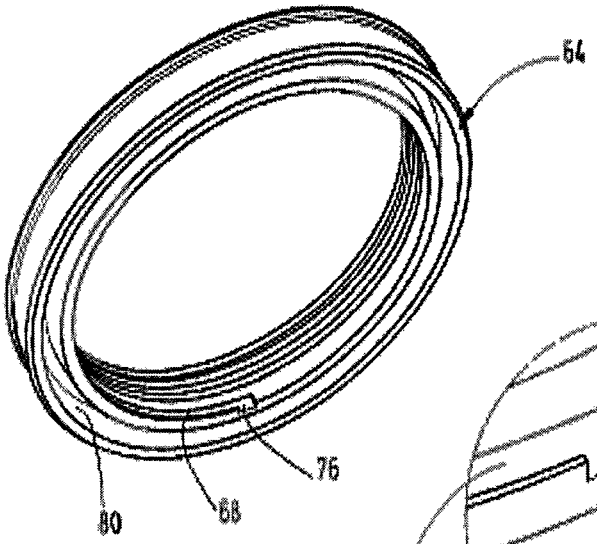
Figure 5B:
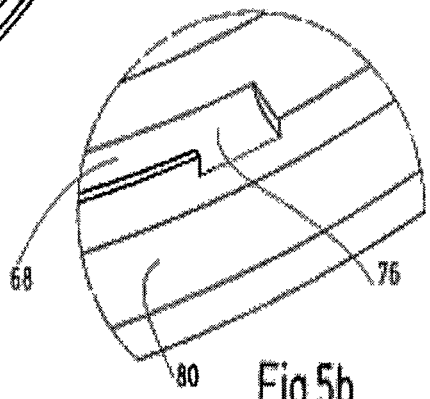
Figure 6B:
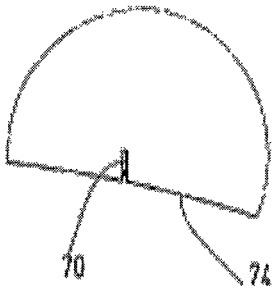
Figure 6A:
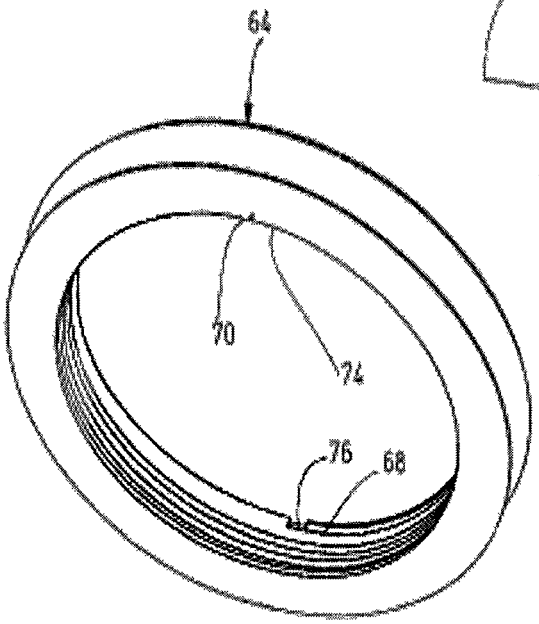

FIG. 4*d* shows an illustration corresponding to FIG. 4*c* of a shaft seal with a sealing lip adhesively bonded therein;

FIGS. 5*a* and *b* show a graphical front view of the shaft seal and an enlargement of a detail therefrom;

FIGS. 6*a* and *b* show a graphical rear view of the shaft seal and an enlargement of a detail therefrom.

The material feed container 10, which is mounted on a framework 12, according to FIGS. 1*a* to *d* is part of a two-cylinder high-viscosity material pump, the conveying cylinders 14 of which are connected to the material feed container 10 via conveying cylinder openings 16 in the container wall 18. A pressure joint 22 to which a conveying line 24 of the high-viscosity material pump is connected is located on that end wall 20 of the material feed container that is opposite the container wall 18. The container interior here contains a pipe branching assembly 26 which is designed as an S pipe, is connected at one end thereof to the pressure joint 22 and the other end of which is pivotable about the axis of the drive shaft 28 in an alternating manner in front of the two conveying cylinder openings 16 with the aid of two plunger cylinders 39. At the cylinder-side end therefor, the pipe branching assembly 26 bears a wearing ring 29 which is displaceable on a wearing spectacle-like assembly 30 arranged in the region of the conveying cylinder openings 16. The side walls 32 of the material feed container 10 contain a maintenance opening 33 which is closeable by a respective closure flap 34 coupled to the material feed container 10. For this purpose, the closure flaps 34 are connected to the container 10 via a pivoting mechanism 36'. In addition, stirring mechanisms 36 driven by means of a respective hydraulic motor 40 and a drive shaft 38 are mounted rotatably on the closure flaps 34. In the exemplary embodiment shown, the stirring mechanisms 36 are designed as conveying screws which thoroughly mix the high-viscosity material arranged in the container 10 and at the same time convey said material towards the conveying cylinder openings 16. The material feed container 10 is charged via the opening 42, optionally via a filling hopper 46 placeable onto the flange 44.

In order to further show the design of the pipe branching assembly 26 and of the pipe branching assembly drive 42, FIG. 2 shows a modified high-viscosity material pump, which has two conveying cylinders 14, the front openings 16 of which lead into a material feed container 10 and are connectable in an alternating manner to a conveying line 24 during the pressure stroke (arrow 48) via a pipe branching assembly 26 and are open toward the material feed container 10 during the suction stroke (arrow 50) with material being sucked up. The pistons 52 of the conveying cylinders are driven in a push-pull mode by hydraulic means (not illustrated).

In the same manner as in the exemplary embodiment according to FIGS. 1*a* to *d*, the front openings 16 of the conveying cylinders 14 are covered by a wearing spectacle-like assembly 30. On the interior of the material feed container 10, the S-shaped pivoting pipe of the pipe branching assembly 26, with the front side thereof bearing a wearing ring 29, is arranged in front of the wearing spectacle-like assembly 30 so as to be pivotable to and fro about a horizontal axis in such a manner that a cylinder-side opening passes in an alternating manner in front of the one or other opening 16 in the conveying cylinders 14 and opens up the other opening 16 with respect to the interior of the material feed container 10. The pipe branching assembly 26 is actuated via a switching lever 56 which is activatable by hydraulic plunger cylinders 39 and the drive shaft 28 of which reaches through a bearing sleeve 58 in the container wall 18. The bearing sleeve 58 is fixed in the container wall 18 in a liquid-tight manner. The drive shaft 28 reaches through the bearing sleeve 58 with radial play, with an annular gap 62 being left free. A shaft seal 64 made from elastomeric material and spanning the annular gap 62 is arranged at the container-interior end of the bearing sleeve 58. In addition, the annular gap 62 is acted upon with a lubricant from the container exterior via a lubricant bore 66.

A particular characteristic of the invention consists in that the shaft seal 64 has, on the side thereof facing the shaft 28 radially, a conveying thread 68 which assists the conveying of the lubricant in the direction of the container interior and communicates with the container interior via a nonreturn valve 70 opening with respect to the container interior. In the exemplary embodiment shown, the nonreturn valve 70 is formed by a slot opening which intersects the conveying thread 68 at a container-interior end and can be arranged in a sealing lip 74' 74 which is adhesively bonded or formed in said nonreturn valve 70. On the input side, the conveying thread 68 communicates with the annular gap 62 via a wide entry gap 76.

As can be seen from FIGS. 4*a* and *b* the shaft seal 64 engages in an annular groove 78 of the bearing sleeve 58, which annular groove is open toward the drive shaft 28. The shaft seal 64 additionally has an encircling pocket 80 which is open axially counter to the conveying direction of the lubricant and which, upon penetration of lubricant, brings about an additional contact pressure of the shaft seal 64 against the shaft surface and the bearing inner surface. In the exemplary embodiment shown, the shaft seal 64 engages by means of the encircling pocket 80 thereof in the annular groove 78 of the bearing sleeve 58. In order to obtain a consistently constant positioning of the nonreturn valve 70 in the circumferential direction an anti-twist means (not illustrated) is arranged between the bearing sleeve 58 and the shaft seal 64. In the exemplary embodiment shown in FIG. 4*d*, the shaft seal 64 is assembled from two parts which are pressed against each other under the action of the lubricant.

In the exemplary embodiment shown, the shaft seal 64 is illustrated for the case of the drive shaft 28 of a pipe branching assembly 68 in a material feed container 10. It is also possible in principle to arrange such a shaft seal in the region of the pressure joint bearing 82 of the pipe branching assembly 26 or in the region of a bearing sleeve 84 for the stirring mechanism bearing according to FIGS. 1*a* to *d*.

In summary, the following should be noted: the invention relates to a container for accommodating high-viscosity materials, such as liquid concrete. The container 10 has at least one bearing sleeve which reaches through a wall opening and is fixed in the container wall in a liquid-tight manner. A shaft 28 reaches through the bearing sleeve 58 with an annular gap 62 being left free. At the container-interior end of the bearing sleeve 58 there is a shaft seal 64 made from elastomeric material spanning the annular gap 62. The annular gap 62 is acted upon with a lubricant from the container exterior. A special characteristic of the invention consists in that the shaft seal 64 has a conveying thread 68 on the side radially facing the shaft 28, which assists the conveying of the lubricant in the direction of the container interior and expediently communicates with the container interior via a nonreturn valve 70 opening with respect to the container interior.

LIST OF REFERENCE NUMBERS

10 Material feed container
12 Framework
14 Conveying cylinder
16 Conveying cylinder opening
18 Container wall
20 End wall
22 Pressure joint
24 Conveying line
26 Pipe branching assembly
28 Drive shaft
29 Wearing ring
30 Wearing spectacle-like assembly
32 Side walls
33 Maintenance opening
34 Closure flap
36' Pivoting mechanism
36 Stirring mechanism
38 Drive shaft
39 Plunger cylinder
40 Hydraulic motor
42 Opening
44 Flange
46 Filling hopper
48 Arrow (pressure stoke)
50 Arrow (suction stroke)
52 Piston pump
54 Axis
56 Switching lever
58 Bearing sleeve
60 Container wall
62 Annular gap
64 Shaft seal
66 Lubricating bore
68 Conveying thread
70 Nonreturn valve
72 Container interior
74' 74 Sealing lip
76 Entry gap
78 Annular groove
80 Pocket
82 Pressure joint bearing
84 Bearing sleeve

The invention claimed is:

1. A container for accommodating high-viscosity materials, such as liquid concrete, the container comprising:
a container wall having a wall opening and surrounding a container interior,
a bearing sleeve which reaches through the wall opening, is fixed in the container wall in a liquid-tight manner, and comprises a container-interior end,
a shaft reaching through the bearing sleeve,
an annular gap being left free between the bearing sleeve and the shaft, and
a shaft seal made from elastomeric material which is arranged at the container-interior end of the bearing sleeve and spans the annular gap,
wherein the annular gap is acted upon with a lubricant from a container exterior, and
wherein the shaft seal has, on the side thereof facing the shaft radially, a conveying thread which assists conveying of the lubricant in a direction of the container interior and communicates with the container interior.

2. The container as claimed in claim 1, further comprising a nonreturn valve, the nonreturn valve opening with respect to the container interior,
wherein the conveying thread communicates with the container interior via the nonreturn valve.

3. The container as claimed in claim 2, wherein the nonreturn valve is formed by a slot opening or sealing lip bounding the conveying thread at the container-interior end thereof.

4. The container as claimed in claim 1, wherein a pitch of the conveying thread decreases in the conveying direction of the lubricant.

5. The container as claimed in claim 1, wherein the shaft seal engages in an annular groove of the bearing sleeve, which annular groove is open with respect to the shaft.

6. The container as claimed in claim 1, wherein the shaft seal has an encircling pocket which is open axially counter to the conveying direction of the lubricant.

7. The container as claimed in claim 6, wherein the shaft seal and the encircling pocket engage in an annular groove of the bearing sleeve, which annular groove is open with respect to the shaft.

8. The container as claimed in claim 1, wherein an anti-twist device is arranged between the bearing sleeve and the shaft seal.

9. The container as claimed in claim 1, wherein the shaft seal is assembled from at least two parts which are pressed against each other under the action of the lubricant.

10. A system comprising:
a high-viscosity material pump,
a pipe branching assembly,
a stirring mechanism, and
the container as claimed in claim 1,
wherein the container is a material feed container for the high-viscosity material pump, and
wherein the shaft is coupled to the pipe branching assembly or to the stirring mechanism.

11. The system as claimed in claim 10, wherein the bearing sleeve is a flange bearing and/or a pressure joint bearing of the pipe branching assembly.

12. The container as claimed in claim 1, further comprising a stirring mechanism,
wherein the bearing sleeve is a stirring mechanism bearing of the stirring mechanism.

13. A container for accommodating high-viscosity materials, such as liquid concrete, the container comprising:
a container wall having a wall opening and surrounding a container interior,
a bearing sleeve which reaches through the wall opening, is fixed in the container wall in a liquid-tight manner, and comprises a container-interior end,
a shaft reaching through the bearing sleeve,
an annular gap being left free between the bearing sleeve and the shaft, and
a shaft seal made from elastomeric material which is arranged at the container-interior end of the bearing sleeve and spans the annular gap, the shaft seal comprising a circular pocket, the circular pocket comprising a shaft-sided wall, wherein the annular gap is acted upon with a lubricant from a container exterior, wherein the shaft seal has, on the side thereof facing the shaft radially, a conveying thread which assists conveying of the lubricant in a direction of the container interior and communicates with the container interior, wherein the conveying thread has an entry gap, wherein the entry gap is formed as a groove in the shaft-sided wall of the circular pocket of the shaft seal.

* * * * *